US009652981B2

(12) United States Patent
Liu

(10) Patent No.: US 9,652,981 B2
(45) Date of Patent: May 16, 2017

(54) METHOD FOR SYSTEMATICALLY PENALIZING DRIVERS WHO FAIL TO STOP AT A CROSSWALK

(71) Applicant: Yin Liu, Tsuen Wan (HK)

(72) Inventor: Yin Liu, Tsuen Wan (HK)

( * ) Notice: Subject to any disclaimer, the term of this patent is extended or adjusted under 35 U.S.C. 154(b) by 50 days.

(21) Appl. No.: 14/518,992

(22) Filed: Oct. 20, 2014

(65) Prior Publication Data

US 2016/0328959 A1 Nov. 10, 2016

(51) Int. Cl.

| | |
|---|---|
| ***G08G 1/095*** | (2006.01) |
| ***G08G 1/01*** | (2006.01) |
| ***G08G 1/017*** | (2006.01) |
| ***G08G 1/052*** | (2006.01) |
| ***G06Q 50/26*** | (2012.01) |
| ***G08G 1/048*** | (2006.01) |

(52) U.S. Cl.

CPC ..... *G08G 1/01* (2013.01); *G06Q 50/265* (2013.01); *G08G 1/0175* (2013.01); *G08G 1/048* (2013.01); *G08G 1/052* (2013.01)

(58) Field of Classification Search

CPC ..... G06Q 50/265; G06Q 50/28; G08G 1/01; G08G 1/07; G08G 1/05; G08G 1/052; G08G 1/048; G08G 1/164; G08G 1/166; G08G 1/095

USPC ..... 340/936, 944, 925, 932.1, 907, 932; 700/245; 701/70

See application file for complete search history.

(56) References Cited

U.S. PATENT DOCUMENTS

| | | | | |
|---|---|---|---|---|
| 6,384,742 | B1 * | 5/2002 | Harrison | B61L 29/24 340/917 |
| 7,688,222 | B2 * | 3/2010 | Peddie | E01F 9/559 116/63 P |
| 2005/0270175 | A1 * | 12/2005 | Peddie | E01F 9/559 340/907 |
| 2008/0018494 | A1 * | 1/2008 | Waite | H05B 33/0803 340/907 |
| 2010/0207788 | A1 * | 8/2010 | Jones | G08G 1/095 340/932.1 |
| 2010/0214127 | A1 * | 8/2010 | Lloyd | G08G 1/095 340/925 |
| 2013/0027224 | A1 * | 1/2013 | Wang | G08G 1/07 340/932 |
| 2014/0136414 | A1 * | 5/2014 | Abhyanker | G06Q 50/28 705/44 |
| 2014/0267398 | A1 * | 9/2014 | Beckwith | G08G 1/166 345/633 |
| 2014/0307087 | A1 * | 10/2014 | Evanitsky | G08G 1/164 348/143 |

(Continued)

*Primary Examiner* — Hoi Lau

(57) ABSTRACT

Systems and methods are provided for systematically penalizing drivers who fail to stop at crosswalk on different circumstances. The system and method generally employ a sensor to detect a vehicle approaching the cross walk and ambient conditions. The sensor may collect information about the speed and any changes in speed of the vehicle approaching. An image capture device may be used to identify any passengers waiting to cross or actively crossing within the crosswalk. The analyzer processes the information and determines if a fine should be levied upon the vehicle approaching the cross walk. The analyzer may also determine the magnitude of the fine that is to be issued. An additional camera for sensing vehicle speed may be placed at the cross walk to obtain further information to properly assess a fine.

5 Claims, 4 Drawing Sheets

(56) References Cited

U.S. PATENT DOCUMENTS

| | | | | |
|---|---|---|---|---|
| 2015/0084791 | A1* | 3/2015 | Jang | G08G 1/07 340/944 |
| 2015/0202770 | A1* | 7/2015 | Patron | G05D 1/024 700/245 |
| 2016/0114800 | A1* | 4/2016 | Shimizu | B60W 30/0956 701/70 |
| 2016/0328959 | A1* | 11/2016 | Liu | G06Q 50/265 |

* cited by examiner

METHOD FOR SYSTEMATICALLY PENALIZING DRIVERS WHO FAIL TO STOP AT A CROSSWALK

FIELD OF THE INVENTION

This invention is generally related to the safety of pedestrians crossing in a designated crosswalk. More specifically, this invention is related to identifying vehicles who fail to stop or slow down at a crosswalk and assessing a fine.

BACKGROUND OF THE INVENTION

As roadways and cities become more overcrowded, traffic congestion in cities has led to an increased risk of pedestrians being injured by vehicular traffic. Cities typically have designated specific crosswalk locations for pedestrians to cross safely. Most cities have also implemented regulations that vehicular traffic must yield to pedestrians crossing at designated crosswalk locations. The system in place uses a visual indicator that informs drivers when they must stop, decrease speed and yield before driving across the designated crosswalk. The current system in place relies on both pedestrians and vehicles obeying the regulations before proceeding across a designated crosswalk.

However, many law enforcement agencies do not have the manpower or devices to enforce crosswalk laws. Drivers of motor vehicles often disregard pedestrians in the cross walks. This has led to increase in the number of pedestrians struck by motor vehicles while crossing at cross walks deemed a safe place to cross. Often drivers approach crosswalks at a high rate of speed and fail to slow down or completely stop before proceeding across the cross walk. Lack of the ability to enforce cross walk laws puts pedestrians at an increased risk of injury. Thus, there is a need to be able to identify when a crosswalk is occupied and when a driver fails to stop at a designated crosswalk.

In view of the foregoing, there is a need for ways to identify and assess fines to vehicles that do not yield to pedestrians in a crosswalk.

SUMMARY OF THE INVENTION

According to the embodiments of the invention, a method for systematically penalizing drivers who fail to stop at a crosswalk in different circumstances is provided. The system's components include a plurality of sensors, cameras, a processor and memory.

The memory stores instructions that cause the processor to execute a method. The method generally employs the following steps, in no specific or particular order.

The method begins when a sensor detects a vehicle approaching a crosswalk. A proximity sensor installed on a post near the cross walk will collect information about the approaching vehicle over time. The proximity sensor will determine speed and changes in speed of the approaching vehicle. The proximity sensor will determine what distance the vehicle is from the cross at any given time when there is a change in the vehicles speed.

In another embodiment of the disclosed invention, a system for collecting pedestrian information at the crosswalk using an image capture device and an image analyzer may be fixed to a post near the crosswalk. The image analyzer may determine if a pedestrian is waiting to cross the crosswalk. The image analyzer and image capture device may determine intent to cross the crosswalk by analyzing pedestrian gestures and determine if there is intent to cross the crosswalk.

For clarification of the above, a gesture, such as waving at the image capture device, may be any gesture or just determining a pedestrian is standing at the crosswalk. The image capture device may determine if the pedestrian is disabled, elderly, and/or with a child/infant. The image analyzer may also determine if the pedestrian enters the cross walk suddenly.

In another embodiment of the invention, an ambient sensor may be fixed to a post near the crosswalk and collect environmental factors at the crosswalk. The ambient sensor may determine weather conditions and light conditions at the time any pedestrian or vehicle is present at the crosswalk.

In another embodiment of the invention, using the information collected by the sensors, image capture device and analyzers, the system will determine if the vehicle should be assessed a fine, determine the amount of the fine, and decide whether the fine should be mitigated. The magnitude of the fine will be determined based on the information collected and fine schedule programmed into the system. The fine may increase or decrease based on the speed of the vehicle, and whether the vehicle accelerated or decelerated while approaching the crosswalk. The magnitude of the fine may change based on; the demographic information collected about the pedestrian, the number of pedestrians waiting to cross, whether the pedestrian showed intent to cross at the crosswalk, and/or whether the pedestrian was disabled, elderly, or had an infant with them. The system will determine if the pedestrian enters the crosswalk suddenly and determine if the vehicle approaching had adequate time to slow or stop.

DETAILED DESCRIPTION

Referring now to the figures, a system and method for systematically penalizing drivers who fail to stop at crosswalk on different circumstances is provided. The system generally employs an image capture device, proximity and speed sensors placed at a public crosswalk. A proximity sensor installed on a post near the cross walk will collect information about the approaching vehicle over time. The image analyzer will determine if a pedestrian is waiting to cross at the crosswalk. The image capture device will determine if the pedestrian is disabled, elderly and/or with a child/infant. An ambient sensor will be fixed to a post near the crosswalk and collect environmental factors at the crosswalk. The system will determine the magnitude of the fine based on the information collected and fine schedule programmed into the system. The purpose of the system is to penalize drivers who fail to yield to pedestrians at a crosswalk.

Figure 1:
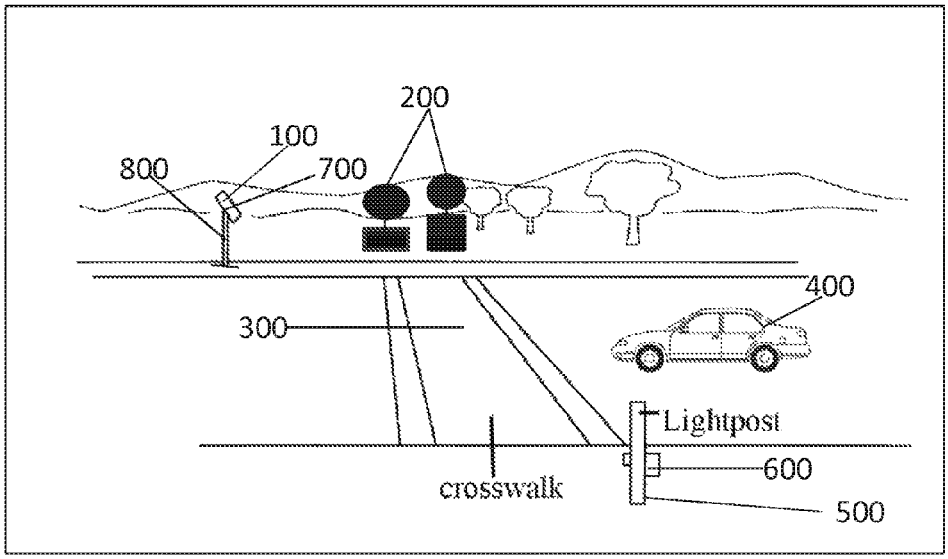
FIG. 1 is a side elevation view of a system according to an embodiment of the presentation.

Referring now to FIG. 1, a side elevation view of a system according to an embodiment of the present invention is shown. The system facilitates penalizing drivers 400 who fail to stop at a crosswalk 300. The system components are a plurality of sensors, and image capture device, a processor and memory. An Image capture device 100 attached to a post 800 collects and analyzes information about a pedestrian and is attached to the post 800 near the crosswalk 300. An image analyzer 700 is also attached to a post near the crosswalk 300. A proximity sensor 600 is attached to a post 500 near the crosswalk 300, and collects &analyzes speed of the vehicle 400 and changes in speed over time at a specific distance from the crosswalk 300. The image capture device 100 may also capture information to identify the approaching vehicle and driver of the vehicle. If a vehicle 400 fails to slowdown or stop and the image capture device 100 has determined that pedestrians 200 are present and waiting to cross at the crosswalk 300, a fine will be assessed to the approaching vehicle 400.

The process begins when a vehicle 400 is detected by the proximity sensor 600 approaching the crosswalk 300. The memory in the system will store vehicle information from the proximity sensor and the speed of the vehicle 400 and any changes in speed of the vehicle.

In a further embodiment of the disclosed invention, a system for detecting pedestrians 200 at the crosswalk 300 maybe employed. An image capture device 100 associated with a processor and memory will identify the pedestrians. The image capture device 100 may determine if the pedestrians are elderly, disabled 450, with an infant/child. The analyzer 700 will determine if the pedestrians 200 showed intent to cross the crosswalk. The analyzer 700 and image capture device 100 may also determine if the pedestrians enter the crosswalk 300 suddenly.

The third step utilizes the information collected and determines if a fine should be given to the driver of the vehicle 400. The magnitude of the fine maybe determined based on the speed of the vehicle 400, if the vehicle failed to slow or stop, and information gathered about the pedestrian(s) 200.

Figure 2:
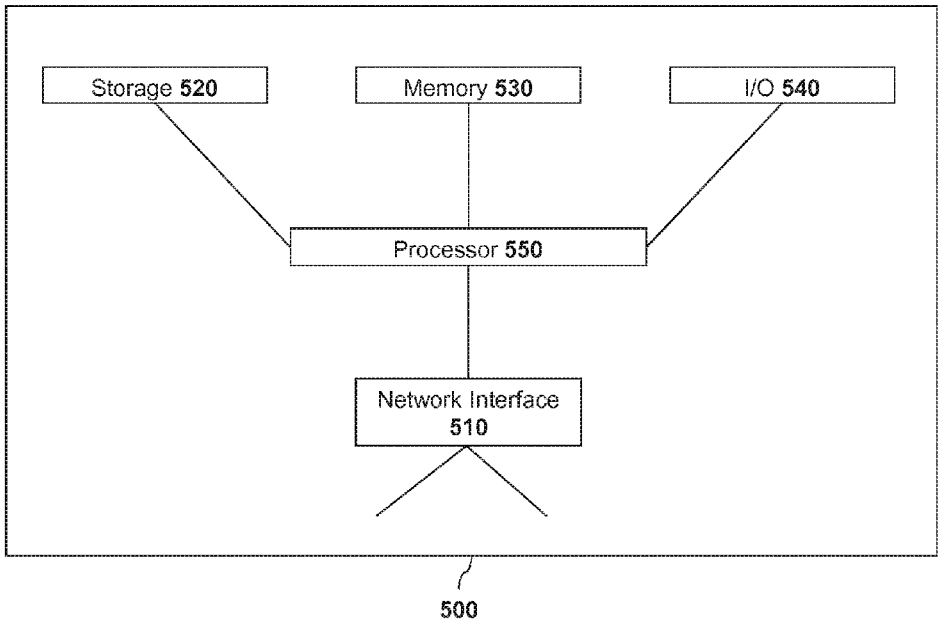
FIG. 2 is a high-level block diagram of a microprocessor device that may be used to carry out the disclosed technology.
Figure 3:
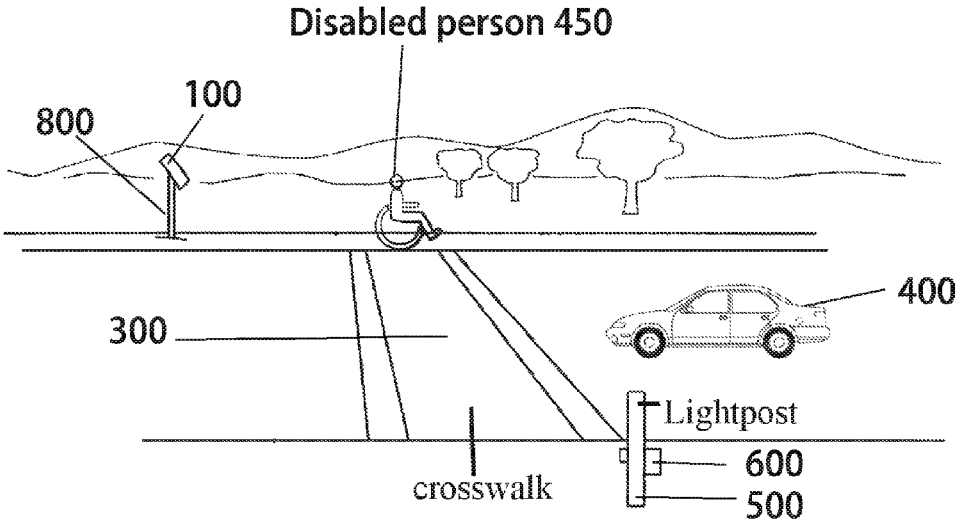
FIG. 3 is a side elevation view of a system according to an embodiment of the presentation when a disabled person is waiting at the crosswalk.
Figure 4:
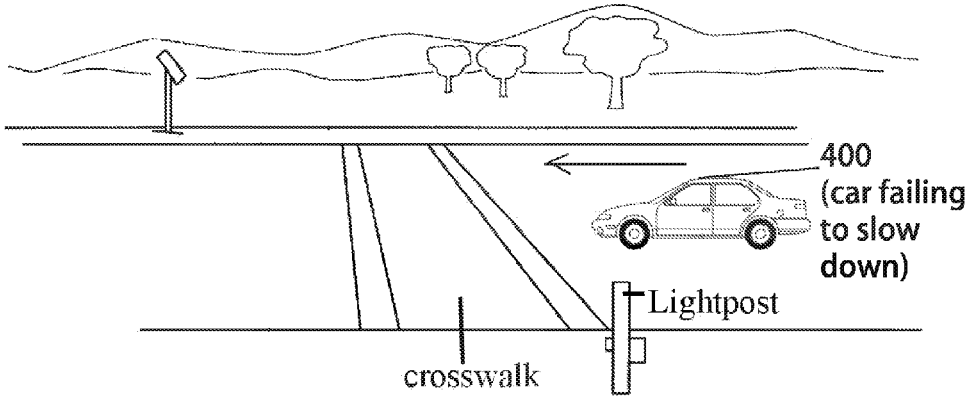
FIG. 4 is a side elevation view of a system according to an embodiment of the presentation when the crossing vehicle fails to slow down when approaching the sidewalk.

FIG. 2 is a high-level block diagram of a microprocessor device that may be used to carry out the disclosed technology. The device 500 comprises a processor 550 that controls the overall operation of a computer by executing the reader's program instructions which define such operation. The device 500 may be, or may be incorporated into the analyzer 700 of FIG. 1. The reader's program instructions may be stored in a storage device 520 (e.g., magnetic disk, database) and loaded into memory 530 when execution of the console's program instructions is desired. Thus, the analyzer 700 will be defined by the program instructions stored in memory 530 and/or storage 520, and the console will be controlled by processor 550 executing the console's program instructions.

The analyzer 700 may also include one or a plurality of input network interfaces for communicating with other devices via a network (e.g., the internet). The analyzer 700 further includes an electrical input interface for receiving power and data. The Analyzer 700 also includes one or more output network interfaces 510 for communicating with other devices. The analyzer 700 may also include input/output 540 representing devices which allow for user interaction with a computer (e.g., display, keyboard, mouse, speakers, buttons, etc.).

One skilled in the art will recognize that an implementation of an actual device will contain other components as well, and that FIG. 2 is a high level representation of some of the components of such a device for illustrative purposes. It should also be understood by one skilled in the art that the method and devices depicted in FIG. 1 may be implemented on a device such as is shown in FIG. 2

While the disclosed invention has been taught with specific reference to the above embodiments, a person having ordinary skill in the art will recognize that changes can be made in form and detail without departing from the spirit and the scope of the invention. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

What is claimed:

1. A method for systematically penalizing drivers who fail to stop at crosswalk on different circumstances, comprising:

determining that a vehicle is approaching to a crosswalk, wherein the determination is made by a proximity sensor included in a light post near the crosswalk;

collecting information about the approaching vehicle by using the proximity sensor over time, including:

speed and rate of change of speed of the vehicle when the vehicle approaching the crosswalk;

at what distance from the crosswalk the approaching vehicle begins to slow down;

whether the approaching vehicle fails to slow down; and whether the approaching vehicle accelerates when approaching the crosswalk;

collecting pedestrian information at the crosswalk by using an image capture device and an image analyzer, including:

whether a pedestrian is waiting to cross the crosswalk;

a number of pedestrians waiting at the crosswalk;

whether the pedestrian shows intent to cross the crosswalk;

whether the pedestrian is a disabled person;

whether the pedestrian is an elderly person;

whether the pedestrian is an infant; and whether the pedestrian shows intent to cross the crosswalk suddenly;

collecting environmental factors regarding the crosswalk by using an ambient sensor, wherein the environmental factors include darkness of the environment;

determining whether the vehicle should be assessed a fine for committing an offence, wherein the determining includes:

assessing whether the driver of the approaching vehicle fails to slow down when the pedestrian is waiting to cross the crosswalk;

assessing whether the driver of the approaching vehicle actually accelerates when the pedestrian is waiting to cross the crosswalk; and assessing whether the driver of the approaching vehicle actually fails to yield the pedestrian to cross the crosswalk;

determining whether additional punishment should be assessed to the driver, wherein the determining includes:

if the pedestrian has waived hands to show intent to cross the crosswalk while the vehicle fails to slow down or even accelerates;

that a plurality of pedestrians have been waiting at the crosswalk for the vehicle to slowdown;

if the pedestrian is the disabled person;

if the pedestrian is the infant; and if the pedestrian is the elderly person;

determining whether the offence should be mitigated, where the determining includes:

whether the pedestrian shows intent to cross the crosswalk when the vehicle is too close to the crosswalk, which would make the vehicle too late to stop before the crosswalk; and determining amount of the offence if determined that the vehicle should be assessed a fine for committing an offence, in accordance with the assessment that the additional punishment should be assessed to the driver, and the assessment whether the offence should be mitigated.

2. A method for systematically penalizing drivers who fail to stop at a crosswalk on different circumstances, comprising:

determining that a vehicle is approaching to a crosswalk, wherein the determination is made by a proximity sensor included in a light post near the crosswalk;

collecting information about the approaching vehicle by using the proximity sensor over time, including:

speed and rate of change of speed of the vehicle when the vehicle is approaching at the crosswalk;

at what distance from the crosswalk that the approaching vehicle begins to slow down;

whether a driver of the approaching vehicle refuses to slow down; and whether a driver of the approaching vehicle actually accelerates before approaching the crosswalk;

collecting pedestrian information at the crosswalk by using an image capture device and an image analyzer, including:

whether a pedestrian is waiting to cross the crosswalk;

number of pedestrians are waiting at the crosswalk;

whether the pedestrian has waived hands to show intent to cross the crosswalk;

whether the pedestrian is a disabled person;

whether the pedestrian is an elderly person;

whether the pedestrian is an infant;

whether the pedestrian shows intent to cross the crosswalk suddenly;

collecting environment factors of the crosswalk by using an ambient sensor, wherein the environment factors include darkness of the environment;

determining whether the vehicle should be assessed a fine for committing an offence, wherein the determining includes:

assessing whether the driver of the approaching vehicle fails to slow down when the pedestrian is waiting to cross the crosswalk;

assessing whether the driver of the approaching vehicle actually accelerates when the pedestrian is waiting to cross the crosswalk; and assessing whether the driver of the approaching vehicle actually fails to yield the pedestrian to cross the crosswalk;

determining whether additional punishment should be assessed to the driver, wherein the determining includes:

if the pedestrian has waived hands to show intent to cross the crosswalk while the vehicle fails to slow down or even accelerates;

that a plurality of pedestrians have been waiting at the crosswalk for the vehicle to slowdown;

if the pedestrian is the disabled person;

if the pedestrian is the infant; and if the pedestrian is the elderly person;

determining whether the offence should be mitigated, where the determining includes:

whether the pedestrian is found too late to show the intent to cross the crosswalk when the vehicle is too close to the crosswalk, which would make the driver too late to stop before the crosswalk;

determining amount of the offence if determined that the vehicle should be assessed a fine for committing an offence, in accordance with the assessment that the additional punishment should be assessed to the driver, and the assessment that whether the offence should be mitigated; and sending the fine to the driver.

3. A system for systematically penalizing drivers who fail to stop at crosswalk on different circumstances, comprising:

a proximity sensor included in a post near a crosswalk, wherein the proximity sensor is used to determine whether a vehicle is approaching to a crosswalk; if determined that the vehicle is approaching to the crosswalk, information is collected about the approaching vehicle by using the proximity sensor over time, including:

speed and rate of change of speed of the vehicle when the vehicle approaching at the crosswalk;

at what distance from the crosswalk that the approaching vehicle begins to slow down;

whether a driver of the approaching vehicle refuses to slow down; and whether a driver of the approaching vehicle actually accelerates before approaching the crosswalk;

an image capture device to collect pedestrian information at the crosswalk;

an image analyzer configured to determine:

whether a pedestrian is waiting to cross the crosswalk;

number of pedestrians are waiting at the crosswalk;

whether the pedestrian has waived hands to show intent to cross the crosswalk;

whether the pedestrian is a disabled person;

whether the pedestrian is an elderly person;

whether the pedestrian is an infant; and whether the pedestrian shows intent to cross the crosswalk suddenly;

an ambient sensor included in the light post to collect environment factors of the crosswalk by using, wherein the environment factors include darkness of the environment; and a processor to execute following steps, comprising:

determining whether the vehicle should be assessed a fine for committing an offence, wherein the determining includes:

assessing whether the driver of the approaching vehicle fails to slow down when the pedestrian is waiting to cross the crosswalk;

assessing whether the driver of the approaching vehicle actually accelerates when the pedestrian is waiting to cross the crosswalk; and assessing whether the driver of the approaching vehicle actually fails to yield the pedestrian to cross the crosswalk;

determining whether additional punishment should be assessed to the driver, wherein the determining includes:

if the pedestrian has waived hands to show intent to cross the crosswalk while the vehicle fails to slow down or even accelerates;

that a plurality of pedestrians have been waiting at the crosswalk for the vehicle to slowdown;

if the pedestrian is the disabled person;

if the pedestrian is the infant; and if the pedestrian is the elderly person;

determining whether the offence should be mitigated, where the determining includes:

whether the pedestrian is found too late to show the intent to cross the crosswalk when the vehicle is too close to the crosswalk, which would make the driver too late to stop before the crosswalk;

determining amount of the offence if determined that the vehicle should be assessed a fine for committing an offence, in accordance with the assessment that the additional punishment should be assessed to the driver, and the assessment that whether the offence should be mitigated; and sending the fine to the driver.

4. A system for systematically penalizing drivers who fail to stop at crosswalk on different circumstances, comprising:

a processing unit that executes steps of a method stored in a memory, the steps comprising:

determining that a vehicle is approaching to a crosswalk, wherein the determination is made by a proximity sensor included in a light post near the crosswalk;

collecting information about the approaching vehicle by using the proximity sensor over time, including:

speed and rate of change of speed of the vehicle when the vehicle approaching the crosswalk;

at what distance from the crosswalk the approaching vehicle begins to slow down;

whether the approaching vehicle fails to slow down; and whether the approaching vehicle accelerates when approaching the crosswalk;

collecting pedestrian information at the crosswalk by using an image capture device and an image analyzer, including:

whether a pedestrian is waiting to cross the crosswalk;

a number of pedestrians waiting at the crosswalk;

whether the pedestrian shows intent to cross the crosswalk;

whether the pedestrian is a disabled person;

whether the pedestrian is an elderly person;

whether the pedestrian is an infant; and whether the pedestrian shows intent to cross the crosswalk suddenly;

collecting environmental factors regarding the crosswalk by using an ambient sensor, wherein the environmental factors include darkness of the environment;

determining whether the vehicle should be assessed a fine for committing an offence, wherein the determining includes:

assessing whether the driver of the approaching vehicle fails to slow down when the pedestrian is waiting to cross the crosswalk;

assessing whether the driver of the approaching vehicle actually accelerates when the pedestrian is waiting to cross the crosswalk; and assessing whether the driver of the approaching vehicle actually fails to yield the pedestrian to cross the crosswalk;

determining whether additional punishment should be assessed to the driver, wherein the determining includes:

if the pedestrian has waived hands to show intent to cross the crosswalk while the vehicle fails to slow down or even accelerates;

that a plurality of pedestrians have been waiting at the crosswalk for the vehicle to slowdown;

if the pedestrian is the disabled person;

if the pedestrian is the infant; and if the pedestrian is the elderly person;

determining whether the offence should be mitigated, where the determining includes:

whether the pedestrian shows intent to cross the crosswalk when the vehicle is too close to the crosswalk, which would make the vehicle too late to stop before the crosswalk; and determining amount of the offence if determined that the vehicle should be assessed a fine for committing an offence, in accordance with the assessment that the additional punishment should be assessed to the driver, and the assessment whether the offence should be mitigated.

5. A system for systematically penalizing drivers who fail to stop at a crosswalk on different circumstances, comprising:

a processing unit that executes steps of a method stored in a memory, the steps comprising:

determining that a vehicle is approaching to a crosswalk, wherein the determination is made by a proximity sensor included in a light post near the crosswalk;

collecting information about the approaching vehicle by using the proximity sensor over time, including:

speed and rate of change of speed of the vehicle when the vehicle is approaching at the crosswalk;

at what distance from the crosswalk that the approaching vehicle begins to slow down;

whether a driver of the approaching vehicle refuses to slow down; and whether a driver of the approaching vehicle actually accelerates before approaching the crosswalk;

collecting pedestrian information at the crosswalk by using an image capture device and an image analyzer, including:

whether a pedestrian is waiting to cross the crosswalk;

number of pedestrians are waiting at the crosswalk;

whether the pedestrian has waived hands to show intent to cross the crosswalk;

whether the pedestrian is a disabled person;

whether the pedestrian is an elderly person;

whether the pedestrian is an infant;

whether the pedestrian shows intent to cross the crosswalk suddenly;

collecting environment factors of the crosswalk by using an ambient sensor, wherein the environment factors include darkness of the environment;

determining whether the vehicle should be assessed a fine for committing an offence, wherein the determining includes:

assessing whether the driver of the approaching vehicle fails to slow down when the pedestrian is waiting to cross the crosswalk;

assessing whether the driver of the approaching vehicle actually accelerates when the pedestrian is waiting to cross the crosswalk; and assessing whether the driver of the approaching vehicle actually fails to yield the pedestrian to cross the crosswalk;

determining whether additional punishment should be assessed to the driver, wherein the determining includes:

if the pedestrian has waived hands to show intent to cross the crosswalk while the vehicle fails to slow down or even accelerates;

that a plurality of pedestrians have been waiting at the crosswalk for the vehicle to slowdown;

if the pedestrian is the disabled person;

if the pedestrian is the infant; and if the pedestrian is the elderly person;

determining whether the offence should be mitigated, where the determining includes:

whether the pedestrian is found too late to show the intent to cross the crosswalk when the vehicle is too close to the crosswalk, which would make the driver too late to stop before the crosswalk;

determining amount of the offence if determined that the vehicle should be assessed a fine for committing an offence, in accordance with the assessment that the additional punishment should be assessed to the driver, and the assessment that whether the offence should be mitigated; and sending the fine to the driver.

* * * * *